US005727442A

United States Patent [19]

Wimmer

[11] Patent Number: 5,727,442

[45] Date of Patent: Mar. 17, 1998

[54] SAFETY DEVICE AT HYDRAULIC PISTON-CYLINDER UNITS

[75] Inventor: Alois Wimmer, Hof b. Salzburg, Austria

[73] Assignee: Wimmer Hartstahl Ges.mbH & Co. KG, Thalgau, Austria

[21] Appl. No.: 549,694

[22] PCT Filed: Feb. 21, 1995

[86] PCT No.: PCT/AT95/00037

§ 371 Date: Nov. 2, 1995

§ 102(e) Date: Nov. 2, 1995

[87] PCT Pub. No.: WO95/23925

PCT Pub. Date: Sep. 8, 1995

[30] Foreign Application Priority Data

Mar. 2, 1994 [AT] Austria ..... 448/94

[51] Int. Cl.[6] ..... F15B 15/26

[52] U.S. Cl. ..... 91/42; 91/43; 91/44; 91/45

[58] Field of Search ..... 91/1, 41, 42, 43, 91/44, 45, 419, 424

[56] References Cited

U.S. PATENT DOCUMENTS

| | | | |
|---|---|---|---|
| 3,608,431 | 9/1971 | Pease, III | 91/1 X |
| 3,654,833 | 4/1972 | Griffiths | 91/41 |
| 3,680,972 | 8/1972 | Ringholm | 415/36 |
| 3,782,249 | 1/1974 | Drone | 91/44 |
| 4,423,664 | 1/1984 | Buchl | 91/1 |
| 5,049,027 | 9/1991 | Morrison et al. | 414/723 |
| 5,096,347 | 3/1992 | Kumagai et al. | 91/44 X |
| 5,468,042 | 11/1995 | Heinrichs et al. | 296/146.4 |

FOREIGN PATENT DOCUMENTS 2146388 3/1973 France .

OTHER PUBLICATIONS

Emergemcy & Fail Safe Circuits, Hydraulic Pneumatic Power, J.E. Graham, May 1969.

*Primary Examiner*—Hoang Nguyen

*Attorney, Agent, or Firm*—Herbert L. Lerner; Laurence A. Greenberg; Werner H. Stemer

[57] ABSTRACT

The invention relates to a safety arrangement on hydraulic piston-cylinder units. In particular for monitoring locking cylinders, e.g., of operating tools mounted on a grab bucket boom. A sensor for monitoring the piston position is provided on the piston-cylinder unit and is coupled electrically to a monitoring circuit for triggering an alarm arrangement if the piston is incorrectly positioned. The sensor (3) is coupled to an electrically actuatable locking valve (2) coupled in the monitoring circuit (9) for controlling the hydraulic piston-cylinder unit (1).

4 Claims, 3 Drawing Sheets

SAFETY DEVICE AT HYDRAULIC PISTON-CYLINDER UNITS

BACKGROUND OF THE INVENTION

1. Field of the Invention

The invention pertains to a safety device at hydraulic piston-cylinder units, in particular for monitoring locking cylinders of, for example, operating tools mounted on a dredger bucket boom, whereby a sensor for monitoring the piston position is provided at the hydraulic piston-cylinder unit, which sensor is electrically coupled with a monitoring circuit for triggering an alarm system in the case of an incorrect piston position.

It is particularly essential in locking cylinders that the correct position of the locking means, which are actuated with the hydraulic piston-cylinder unit, is dependably maintained in the locking position and that it is also monitored whether they move out of their locking position due to the operating movement of the operating tool.

A monitoring device of the above-noted kind is known, for instance, from U.S. Pat. No. 5,049,027 which provides a micro-switch which is closed only when the locking cylinder is retracted and then causes a control lamp to light up. That prior art configuration has the disadvantage that the locking cylinders can be freely actuated while the control system need not be taken into consideration.

The invention is based on the object to provide a safety device of the above-noted kind in which free actuation of the locking cylinders is prevented, i.e. that the cylinders must be consciously unlocked so as to attain a release of the operating tools.

2. Summary of the Invention

This object is solved, in accordance with the invention, in that the sensor is coupled with an electrically actuated locking valve coupled to the monitoring circuit for triggering the hydraulic piston-cylinder unit. It is thus necessary to actuate the electrically actuated locking valve through the monitoring circuit before the locking cylinder is actuated, because the locking valve serves the purpose to hold the locking cylinder in its new adjusted position after the adjustment, whereby that locking valve is only opened for adjusting the locking cylinder. It is further assured that the sensor also checks the control circuit for the locking valve.

It is advantageous if a push switch for overriding the monitoring circuit is provided for actuating the locking valve. Only after the push switch has been pushed is an adjustment possible of the locking cylinder by corresponding actuation thereof. Finally, it is also possible to provide the monitoring circuit with a relay switch triggered by the sensor for triggering the alarm system, which makes it possible in a simple manner to turn on alarm circuits quickly through the monitoring circuit.

It may be stated, in summary, that the safety device serves the purpose of forcing the operator to use two hands for locking and unlocking the locking cylinder, i.e. that the locking valve is opened with one hand and the locking cylinder is then actuated with the other hand. It is thus impossible for a grab bucket to be exchanged while the grab bucket boom is actuated; the latter leads to an increased accident risk to persons at the construction site, because it is possible for the operating tool to be received on the boom which the locking cylinder has not been inserted into a corresponding opening, but the tool is only held by clamping.

DESCRIPTION OF THE PREFERRED EMBODIMENT

Figure 1:
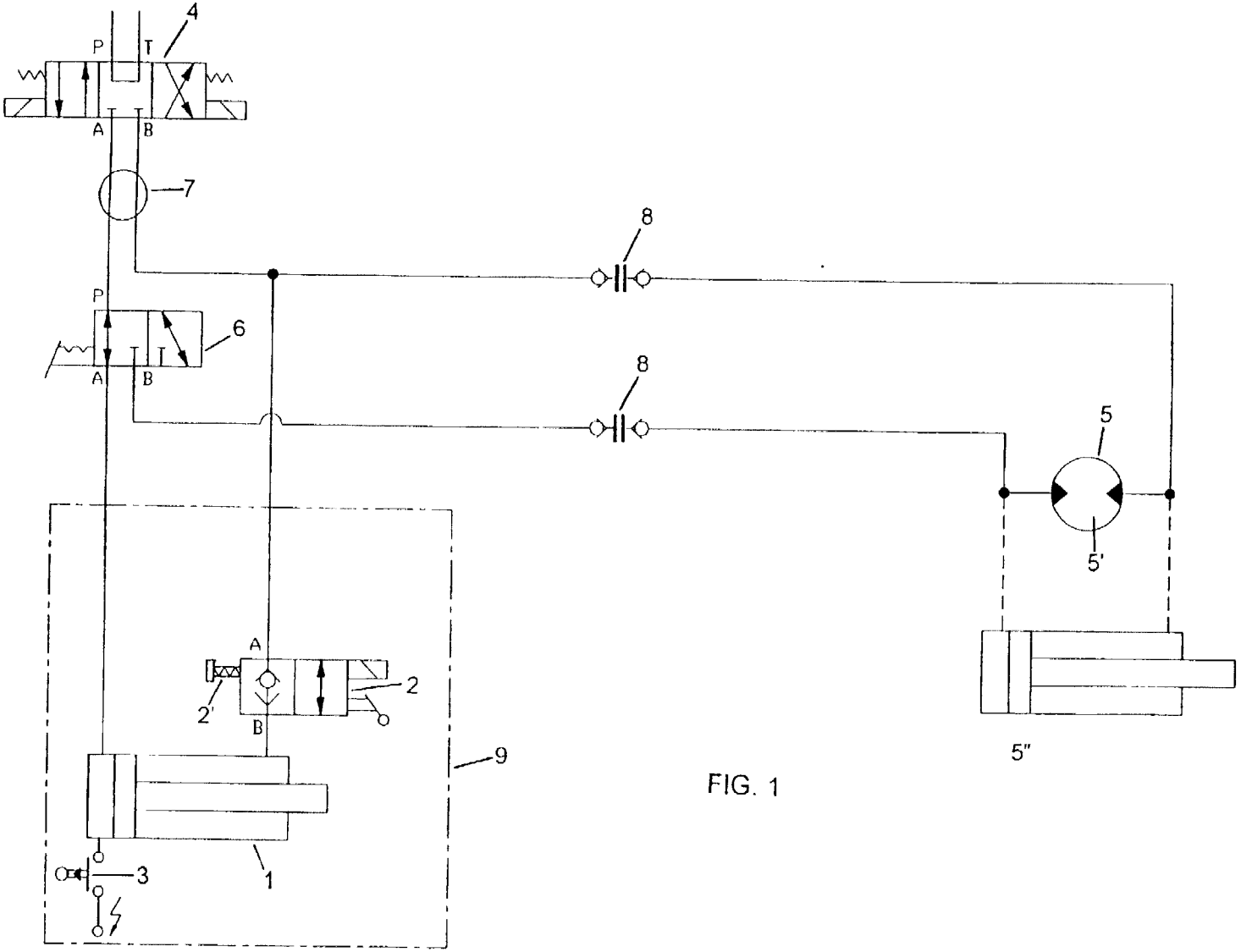
FIG. 1 is a diagram of an hydraulic circuit for a mounting tool at a grab bucket boom at which a locking cylinder with a safety device is provided.

Numeral 1 refers to an hydraulic piston-cylinder unit which, in the exemplary embodiment, forms the locking cylinder of a coupling device for operating tools at a grab bucket boom. The hydraulic piston-cylinder unit 1 can be arrested in the desired position via a locking cylinder. A sensor 3 for monitoring that position is provided; the sensor ascertains whether or not the operating piston of the hydraulic piston-cylinder unit 1 lies in the desired position. The hydraulic piston-cylinder unit 1 is actuated through a control valve 4 which may, at the same time, also form the control valve for an operating tool. Such an operating tool is indicated at 5 by way of example, whereby FIG. 1 illustrates two variant embodiments, namely either a gripper rotator motor 5' or a pivot cylinder 5" for a sloped embankment grab bucket.

The numeral 6 refers to a control valve for the hydraulic piston-cylinder unit 1, with which the hydraulic loops can be switched such that either the hydraulic piston-cylinder unit 1 or the operating tool 5 may be controlled. Reference numeral 8 refers to plug couplings for connecting the hydraulic lines with the operating tool. A so-called swivel block is shown at 7, i.e. the flexible connection between the rigid hydraulic lines at the dredging bucket boom and the hydraulic lines at the pivotable coupling part for the operating tools.

Figure 2:
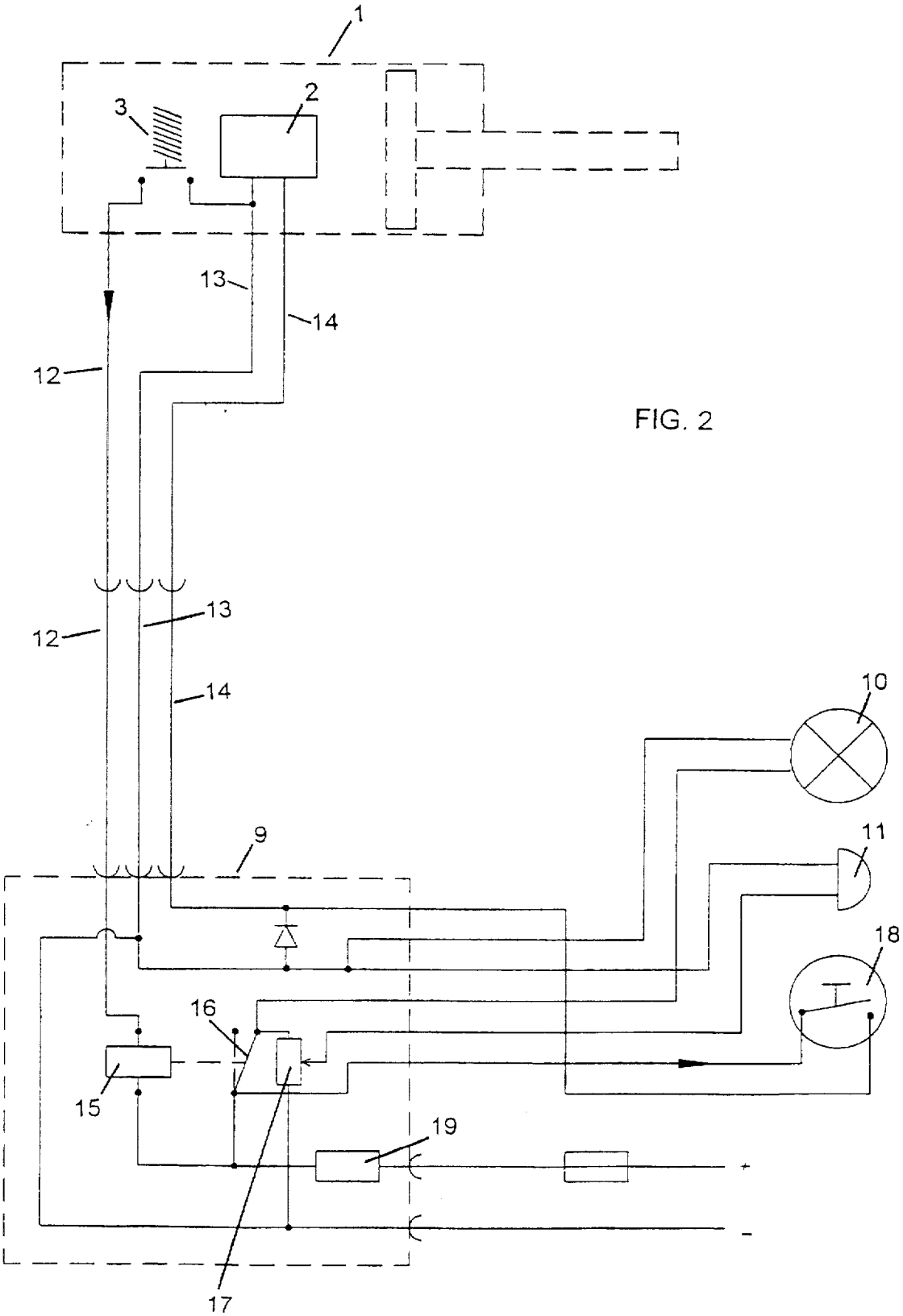
FIG. 2 is a diagram of an electrical circuit for a monitoring device of the locking cylinder.
Figure 4:
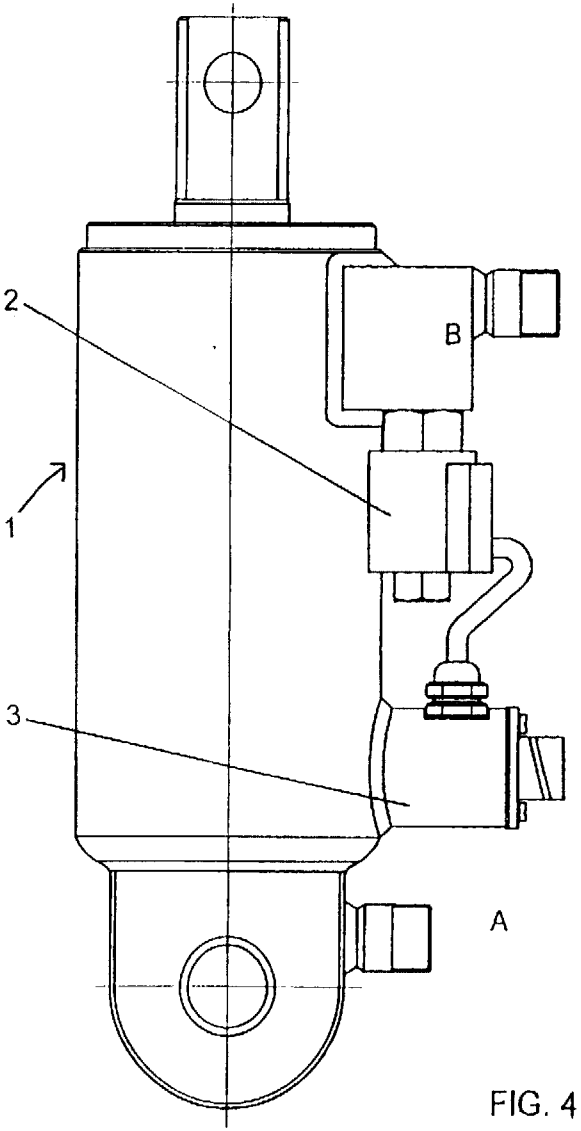
FIG. 4 is a side view of the locking cylinder as seen in the direction of the arrow A in FIG. 3.
Figure 3:
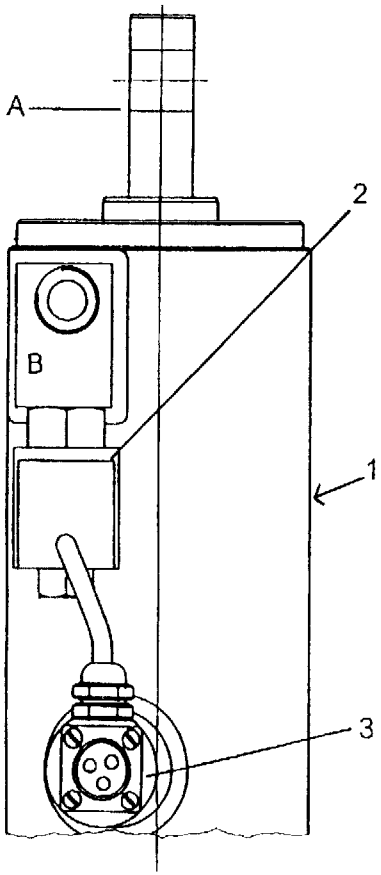
FIG. 3 is a front view of a locking cylinder.

The sensor 3 is connected with a monitoring circuit, which is provided for triggering an alarm system consisting of a control lamp 10 and a siren 11. The connection between the sensor 3 and the monitoring circuit 9 is effected through lines 12 and 13, whereby the line 13 also forms the trigger line for the locking valve 2. The locking valve 2 is additionally connected with the monitoring circuit via the line 14 (cf. FIG. 2).

A relay switch 15 is provided in the monitoring circuit 9 which actuates a switch 16. The switch 16 serves the purpose to turn on the alarm systems 10 and 11 or, in the correct position of the sensor, to turn them off. Numeral 17 refers to a potentiometer which is connected in parallel with the switch 16 and which serves to supply the siren 11. Numeral 18 pertains to a push switch for bridging the line 14 to the locking valve, whereby a fuse 19 is connected inline. The push switch 18 serves the purpose to close the current circuit and to actuate the locking valve 2 such that it switches to throughput and thus allows actuating the hydraulic piston-cylinder unit 1 via the control valve 4 when the control valve 6 is in the correct position.

In the position of the valves illustrated in FIG. 1 the control valve is in its rest position, the control valve 6 is adjusted to connect with the hydraulic piston-cylinder unit 1 and the locking valve 2 is locked. The sensor 3 is closed in this locked position, so that the relay switch 15 is subject to a current and the switch 16 is brought to the position which is illustrated in dashed lines in FIG. 2. In this way the alarm systems 10 and 11 are out of operation and the hydraulic piston-cylinder unit, or the locking cylinder formed thereby, is in its operative position.

If now, for any reason, the locking cylinder moves out of its position illustrated in FIG. 1, be it for a leak in the lines or for any other external reasons, then the sensor 3 interrupts the flow of current between the lines 12 and 13, whereby the relay switch 15 becomes current-less and falls off. This moves the switch 16 into its position shown in solid lines in FIG. 2 and closes the current circuit for the alarm system 10 and 11. The operator of the excavator thus is alerted to the fact that something is amiss in the locking of the operating tool. The operator then is forced to check the seating and the position of the locking cylinder.

When the operating tool at the excavator boom is to be exchanged, i.e. when the locking cylinder is to be unlocked, then the locking valve 2 must first be switched through by the switch 18, which is effected in that the locking valve 2 is formed as a magnet valve in which the valve, upon exposure to a current flow, is switched into flow-through position against the force of a spring 2'. Then it is possible for the piston of the hydraulic piston-cylinder unit 1 to be shifted into its unlocked position via the control valve 4. The relay switch 15 is currentless during the entire operating tool exchange operation so that the alarm system 10, 11 is activated during the entire exchange operation, and it is only turned off after the locking cylinder is fully engaged and the sensor 3 is closed and, accordingly, the relay switch 15 is actuated and the switch 16 is brought into its position illustrated in dashed lines in FIG. 2. As soon as the alarm system 10, 11 is turned off, the operator of the excavating machine knows that the locking cylinder has properly engaged.

If the operating tool 5 is to be actuated by means of the control valve 4, then the control valve 6 is moved from its position illustrated in FIG. 1 into the alternative position, whereby then the two plug-in connections 8 are under pressure and thus actuate the operating tool depending on the position of the valve 14. The hydraulic piston-cylinder unit 1 is then uncoupled from the hydraulic pressure and the hydraulic fluid in the system of the hydraulic piston-cylinder unit 1 is thus locked therein, and any readjustment of the locking cylinder is thus prevented during the operation with the operating tool.

I claim:

1. A safety device for an hydraulic piston-cylinder unit, comprising:

a sensor disposed at an hydraulic piston-cylinder unit for monitoring a relative position of a piston thereof;

a monitoring circuit and an alarm system triggered by said monitoring circuit, said sensor being electrically connected to said monitoring circuit for reporting to said monitoring circuit if the piston is in an incorrect position; and an electrically actuatable locking valve for actuating the hydraulic piston-cylinder unit, said locking valve being coupled to said sensor and to said monitoring circuit.

2. The safety device according to claim 1, which further comprises a push switch for actuating the locking valve, said push switch being connected so as to bridge said monitoring circuit.

3. The safety device according to claim 1, which further comprises a relay switch connected to and actuated by said sensor for triggering said alarm system.

4. A safety device for monitoring a locking cylinder of an hydraulic piston-cylinder unit of an operating tool mounted on an excavator bucket boom, the improvement which comprises:

a sensor disposed at and monitoring a relative position of a piston of the locking cylinder; a monitoring circuit and an alarm system triggered by said monitoring circuit, said sensor being electrically connected to said monitoring circuit for reporting to said monitoring circuit if the piston is in an incorrect positions and an electrically actuatable locking valve for actuating the hydraulic piston-cylinder unit, said locking valve being coupled to said sensor and to said monitoring circuit.

* * * * *